US010994186B1

(12) United States Patent
Dickerson

(10) Patent No.: US 10,994,186 B1
(45) Date of Patent: May 4, 2021

(54) BASKETBALL RETURN BACKSTOP NET ASSEMBLY

(71) Applicant: Rukket, LLC, Wilmington, DE (US)

(72) Inventor: Ryan L. Dickerson, Athens, GA (US)

(73) Assignee: Rukket, LLC, Wilmington, DE (US)

( * ) Notice: Subject to any disclaimer, the term of this patent is extended or adjusted under 35 U.S.C. 154(b) by 0 days.

(21) Appl. No.: 16/674,664

(22) Filed: Nov. 5, 2019

Related U.S. Application Data

(60) Provisional application No. 62/774,530, filed on Dec. 3, 2018.

(51) Int. Cl.

| | |
|---|---|
| ***A63B 69/00*** | (2006.01) |
| ***A63B 71/02*** | (2006.01) |
| ***A63B 63/08*** | (2006.01) |
| *A63B 63/00* | (2006.01) |

(52) U.S. Cl.
CPC ..... *A63B 71/022* (2013.01); *A63B 63/083* (2013.01); *A63B 69/0071* (2013.01); *A63B 71/028* (2013.01); *A63B 2063/001* (2013.01)

(58) Field of Classification Search
CPC . A63B 63/083; A63B 69/0071; A63B 71/028; A63B 2063/001; A63B 69/022
USPC ..... 473/433, 431, 432, 434, 435, 447, 422, 473/473–476, 197; 273/394–397
See application file for complete search history.

(56) References Cited

U.S. PATENT DOCUMENTS

| | | | | |
|---|---|---|---|---|
| 3,195,898 | A * | 7/1965 | Respini | A63B 63/00 473/197 |
| 3,901,506 | A * | 8/1975 | Caveney | A63B 69/0071 473/433 |
| 4,045,032 | A * | 8/1977 | Cox | A63B 71/022 473/197 |
| 4,880,239 | A * | 11/1989 | Leneveu | A63B 63/00 473/192 |
| 5,129,648 | A | 7/1992 | Sweeney et al. | |
| 5,273,275 | A | 12/1993 | Wilkerson | |
| 5,312,099 | A * | 5/1994 | Oliver, Sr. | A63B 63/083 473/433 |
| 5,368,292 | A | 11/1994 | Metz | |
| 5,402,999 | A | 4/1995 | Keehn, Sr. | |
| 5,409,211 | A | 4/1995 | Adamek | |
| 5,746,668 | A | 5/1998 | Ochs | |
| 5,971,873 | A | 10/1999 | Balducci | |
| 6,056,652 | A | 5/2000 | Lees et al. | |
| 6,074,313 | A | 6/2000 | Pearson | |
| 6,416,431 | B1 | 7/2002 | Keehn, Sr. et al. | |
| 6,595,877 | B2 | 7/2003 | Pearson | |

(Continued)

*Primary Examiner* — Mitra Aryanpour
(74) *Attorney, Agent, or Firm* — Rogowski Law LLC

(57) ABSTRACT

A freestanding basketball backstop assembly returns basketballs shot at a basketball hoop to a player positioned at a location spaced apart from the basketball hoop. A net support has a base and side legs, with vertical rods removably insertable into sockets of the side legs and threaded through sleeves extending from the side edges of the net peripheral border. The base is placed in front of the post supporting the basketball backboard. The net is arranged behind the post supporting the backboard. A slit opening in the bottom periphery of the net receives a portion of the post supporting the backboard. Top corners of the net are connected to the tops of the vertical rods. Bottom corners of the net are attached to front edges of the side legs. The vertical rods keep the net in tension behind the backboard.

18 Claims, 6 Drawing Sheets

(56) References Cited

U.S. PATENT DOCUMENTS

| | | | | |
|---|---|---|---|---|
| 6,733,403 | B2 | 5/2004 | Courtright | |
| 6,746,348 | B2 | 6/2004 | Barnes et al. | |
| 6,761,649 | B1 | 7/2004 | Medley, Jr. | |
| 7,244,199 | B1 * | 7/2007 | Romano | A63B 71/022 273/127 R |
| 7,510,492 | B2 | 3/2009 | Hudson | |
| 7,530,909 | B2 | 5/2009 | Thomas et al. | |
| 8,460,129 | B2 | 6/2013 | Forlini et al. | |
| 8,845,460 | B1 | 9/2014 | Feldstein | |
| 8,852,030 | B2 | 10/2014 | Campbell et al. | |
| 8,876,637 | B2 | 11/2014 | Atkins | |
| 9,289,663 | B1 | 3/2016 | Bollinger | |
| 9,717,973 | B2 | 8/2017 | Elpers et al. | |
| 10,124,233 | B2 * | 11/2018 | Nelson | A63B 69/00 473/433 |
| 10,576,353 | B2 * | 3/2020 | Givens | A63B 1/00 473/433 |
| 2017/0282034 | A1 * | 10/2017 | Elpers | A63B 71/022 473/433 |

* cited by examiner

BASKETBALL RETURN BACKSTOP NET ASSEMBLY

CROSS-REFERENCE TO RELATED APPLICATION

This application claims priority under 35 USC § 119(e) to U.S. Provisional Application Ser. No. 62/774,530, entitled "Basketball Return Backstop Net Assembly", filed Dec. 3, 2018, the disclosure of which is incorporated by reference herein.

FIELD OF THE INVENTION

The present invention is generally directed to a freestanding basketball return backstop net assembly for use with a basketball hoop and backboard mounted to a vertical post.

BACKGROUND OF THE INVENTION

Basketball players often practice free throws and other shots by tossing a basketball toward the basketball goal or hoop while spaced apart from the goal or hoop. If the players are practicing alone, the player must chase after a rebound for a ball that misses the goal or hoop or must approach the goal or hoop to retrieve a ball after a successful shot into the goal or hoop. Some playground basketball goals are mounted on posts that do not have a gym wall or other wall structure behind the post and backboard. In these cases, errant balls may travel far behind the post and backboard. There is a need for apparatus to return the ball to the player at the player's shooting position.

Basketball retrieval apparatus are known for returning basketballs from behind a basketball backboard. Many of these structures attach nets or screens to the backboard and/or to the vertical post holding the backboard and basketball net. U.S. Pat. No. 7,530,909, for example, shows a basketball return net mounting system that attaches mounting brackets to a rear of a basketball backboard. A net structure is then suspended downwardly from the mounting brackets and under the basket. U.S. Pat. No. 5,971,873, as another example, shows a backstop screen for a basketball net that is attached to mounting structures appended to the top and bottom of the vertical post holding the backboard and the basketball net. U.S. Pat. No. 8,460,129 shows a backstop retrieving device comprising a net that is coupled to clamps that are in turn connected to the top of the backboard. Weights are joined to the bottom of the net.

Basketball players do not always have freedom to connect a backstop or net to the backboard or post of a basketball goal. A freestanding backstop that is quickly assembled and installed, and quickly disassembled, would have advantages over prior retrieval apparatus that must be connected to the backboard or vertical post.

BRIEF SUMMARY OF THE INVENTION

In a first aspect, the invention comprises a basketball backstop assembly to return basketballs shot at a basketball hoop to a player positioned at a location spaced apart from the basketball hoop is a freestanding structure that does not have supporting connections to the backboard or to the post supporting the backboard and hoop. The basketball backstop assembly includes a base having a first end and a second end and a base length between the first end and the second end. The base may comprise multiple segments that are joined together, and may include a rope or cord threaded through the multiple segments. Such rope or cord may be elastic or stretchy.

The basketball backstop assembly further includes a right side leg and a left side leg. One end of the base is removably joined into a receiving socket in the right side leg and the opposite end of the base is removably joined into a receiving socket in the left side leg. The right side leg has a second socket that is disposed at an angle to the first socket, such as an angle between 90 to 120 degrees. The left side leg has a second socket that is disposed at an angle to the first socket, such as an angle between 90 to 120 degrees.

The basketball backstop assembly may include additional right side leg and left side leg extenders to lengthen the right side leg and the left side leg, as desired.

A right vertical rod is removably attachable to the second receiving socket in the right side leg. A left vertical rod removably attachable to the second receiving socket in the left side leg.

In one variant, the right vertical rod is formed from a combination of two or more rod segments threadedly joined together, and the left vertical rod is formed from a combination of two or more rod segments threadedly joined together. Preferably the right vertical rod (or segments thereof) and the left vertical rod (or segments thereof) are formed of fiberglass.

A net having a peripheral border (e.g., having a top, a bottom, a right side and a left side), also defines at least one slit through its bottom peripheral border. The net also has at least one right sleeve associated with its right side and at least one left sleeve associated with its left side. The right vertical rod is threaded through the right sleeve and the left vertical rod is threaded through the left sleeve. In one variant, the net has two or more right sleeves and two or more left sleeves, and the right vertical rod is threaded through the two or more right sleeves and the left vertical rod is threaded through the two or more left sleeves.

At least one cord depends from a first bottom corner of the net peripheral border between the right side and the bottom. Such cord is adapted for removably joining to the right side leg. At least a second cord depends from a second corner of the net peripheral border between the left side and the bottom. Such second cord is adapted for removably joining to the left side leg. The first and second cords may be elastic or stretchy, and may have hooks or other fasteners appended at one or both ends.

At least one loop depends from a first top corner of the net peripheral border between the right side and the top. The at least one loop is adapted for removably joining to a top portion of the right vertical rod. At least one other loop depends from a second top corner of the net peripheral border between the left side and the top. The at least one other loop is adapted for removably joining to a top portion of the left vertical rod. The first and second loops may be formed of stretchy cord or roping material.

In one variant, the basketball backstop assembly further includes at least one fastener associated with the slit in the bottom peripheral border of the net. Moreover, the slit may extend from the bottom of the peripheral border to a length of a portion of the net. In addition, or alternatively, a plurality of fasteners may be incorporated onto or near the slit to join a first slit edge to a second slit edge of the slit.

In another variant, stakes may be used to secure the right side leg to a ground surface and the left side leg to a ground surface.

In a second aspect, the invention comprises a method of assembling the basketball backstop assembly for use with a basketball backboard in a freestanding fashion without need for joining the backstop assembly for support to the backboard or to the post supporting the backboard. The method comprises assembling the base and legs together by joining a first end of the base to a first receiving socket of a right side leg, said right side leg having a right side length and defining a first axis along the right side length, with the first receiving socket along the right side length and disposed at a first angle to the first axis. Then, joining the second end of the base to a third receiving socket of a left side leg, said left side leg having a left side length and defining a second axis along the left side length, said left side leg having the third receiving socket along the left side length, with the third receiving socket disposed at a first angle to the second axis.

Next, the method comprising assembling the vertical rods to the base and side legs by joining a right vertical rod to a second receiving socket of the right side leg, said second receiving socket disposed along the right side length at a second angle to the first axis, and by joining a left vertical rod to a fourth receiving socket of the left side leg, said fourth receiving socket disposed along the left side length at a second angle to the second axis.

As a next step, the net is joined to the vertical rods and to the legs. The net has a peripheral border having a top, a bottom, a right side and a left side, and having the at least one right sleeve associated with its right side, and having at least one left sleeve associated with its left side, said net further defining at least one slit through its bottom peripheral border. The right vertical post is threaded through at least one right sleeve of a net, and the left vertical rod is threaded through the at least one left sleeve of the net. Cords depending from the bottom corners of the net peripheral border are joined to the respective right side leg and left side leg. Loops depending from the top corners of the net peripheral border are joined to the tops of the right vertical rod and left vertical rod.

The basketball backstop assembly is then located so that the top peripheral border of the net is behind the backboard. In a preferred variant, the bottom peripheral border of the net is positioned in front of a post supporting the backboard. More preferably, the slit in the net and net periphery is positioned around the post supporting the backboard. The edges of the slit may be fastened together with at least one fastener provided on the net or on the bottom of the periphery of the net.

The basketball backstop assembly is used without need for fasteners to penetrate the post or into the backboard supported by the post. The basketball backstop assembly is freestanding and has no mountings that must be connected to the post or the backboard supported by the post. The vertical rods create tension in the net due to their flexibility and their positioning with their bottom ends in the sockets of the side legs disposed at angles away from one another.

BRIEF DESCRIPTION OF THE DRAWINGS

The foregoing summary, as well as the following detailed description of the disclosure, will be better understood when read in conjunction with the appended drawings. For the purpose of illustrating the disclosure, there is shown in the drawings an embodiment of a freestanding basketball backstop assembly which is presently preferred. It should be understood, however, that the disclosure is not limited to the precise arrangements and instrumentalities shown. In the drawings.

DESCRIPTION OF THE DISCLOSURE

Certain terminology is used in the following description for convenience only and is not limiting. Unless specifically set forth herein, the terms "a," "an" and "the" are not limited to one element, but instead should be read as meaning "at least one." The terminology includes the words noted above, derivatives thereof and words of similar import.

It also should be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 1:
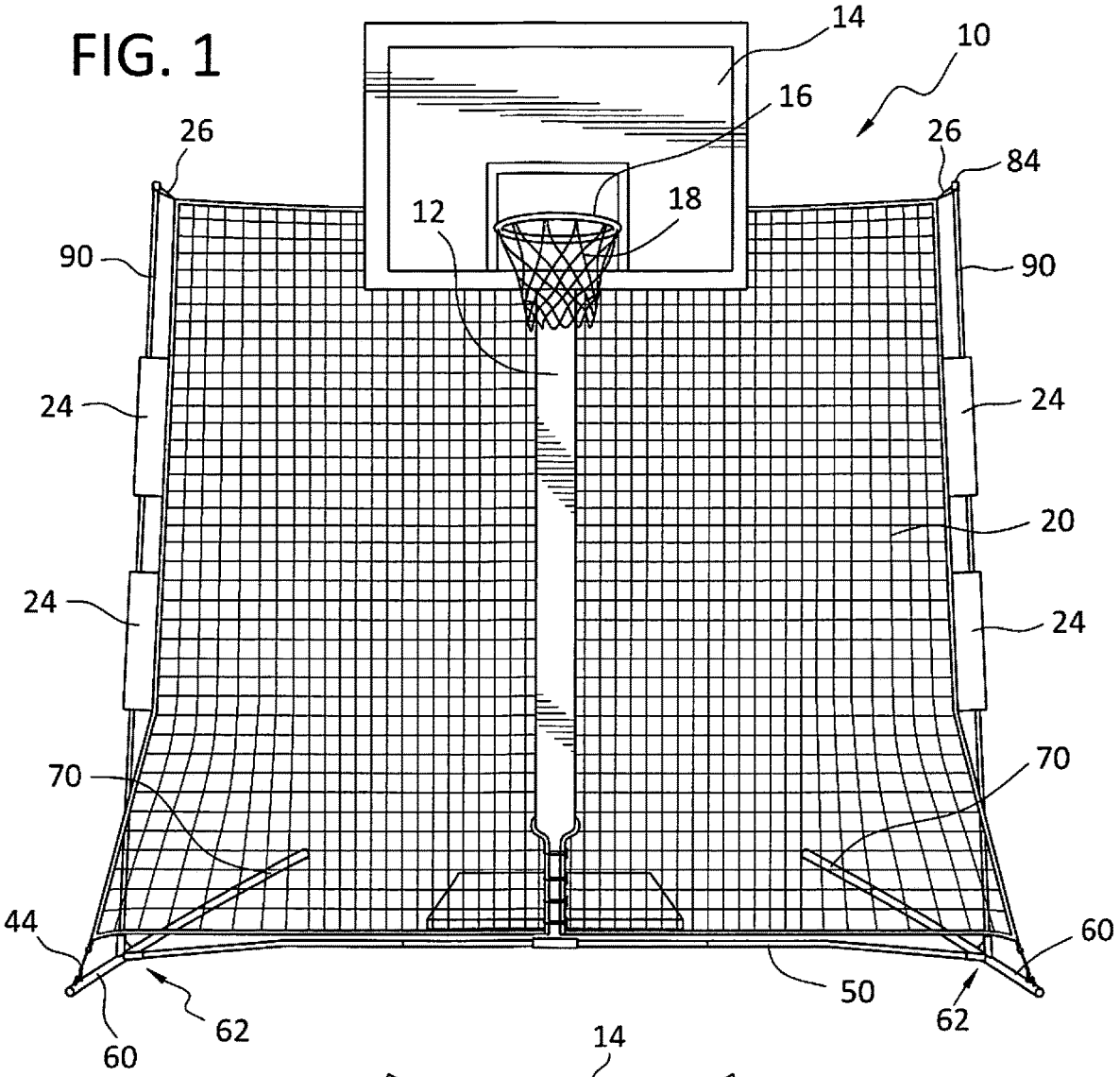
FIG. 1 is a front elevational view of a backstop assembly according to the invention.
Figure 2:
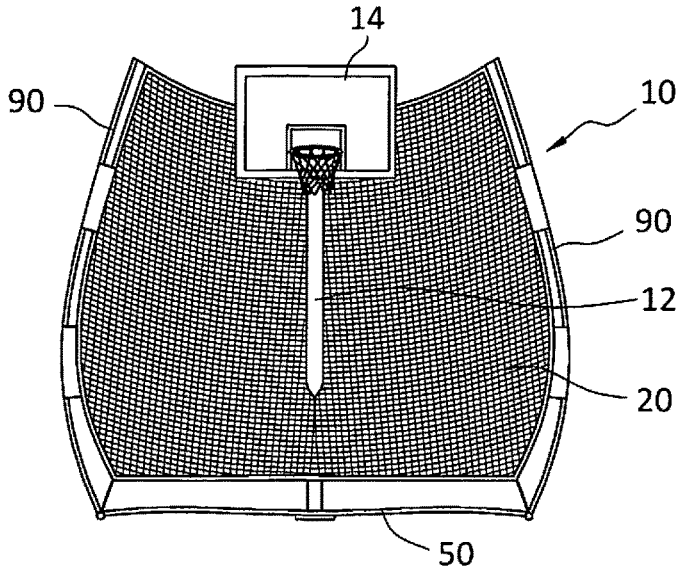
FIG. 2 is an alternative front elevational view of the backstop assembly of FIG. 1.
Figure 3:
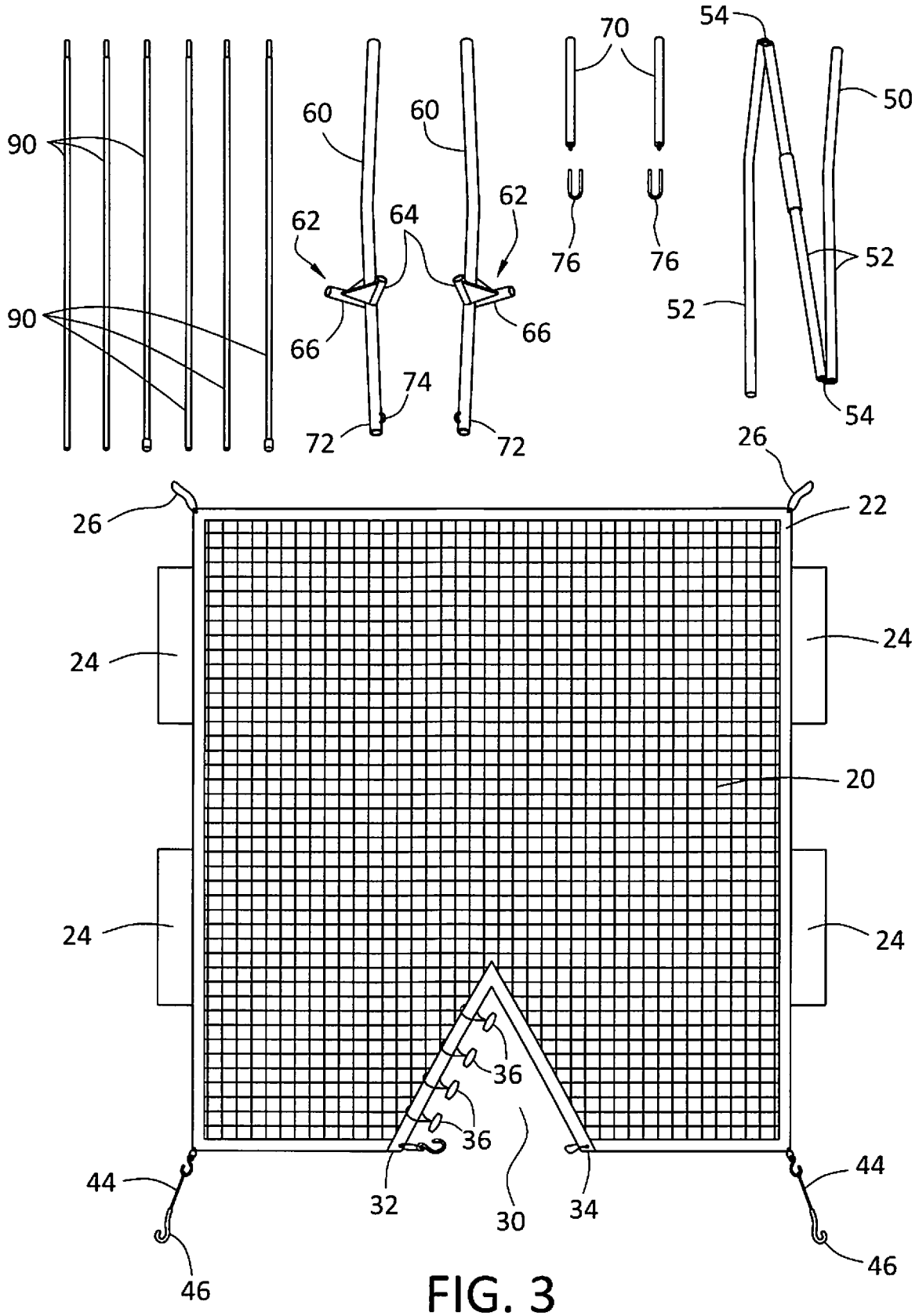
FIG. 3 is a front elevational view of parts for constructing the backstop assembly of FIG. 1.
Figure 16:
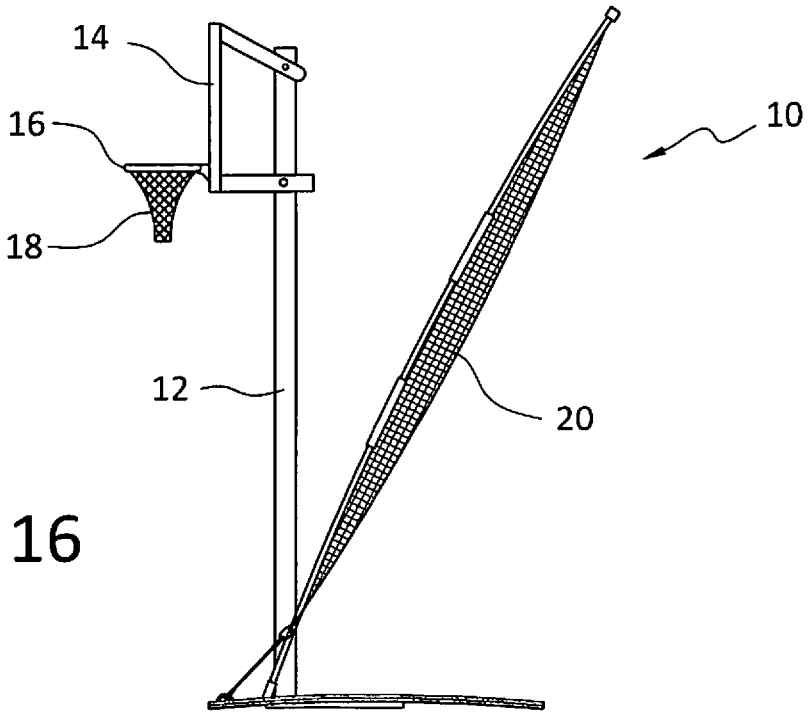
FIG. 16 is a right side elevational view of the backstop assembly if FIG. 1.

Referring to the drawings in detail, FIGS. 1, 2 and 16 show a basketball backstop assembly 10 installed for use with a basketball backboard 14 mounted to a vertical post 12. A hoop 16 to which a basketball net 18 is attached is supported on the backboard 14. The basketball backstop assembly 10 includes a net 20 that is supported by two generally vertically extending rods 90. The rods 90 are supported by a base 50 and side legs 60. The various components to make the basketball backstop assembly 10 are shown in FIG. 3.

Figure 4:
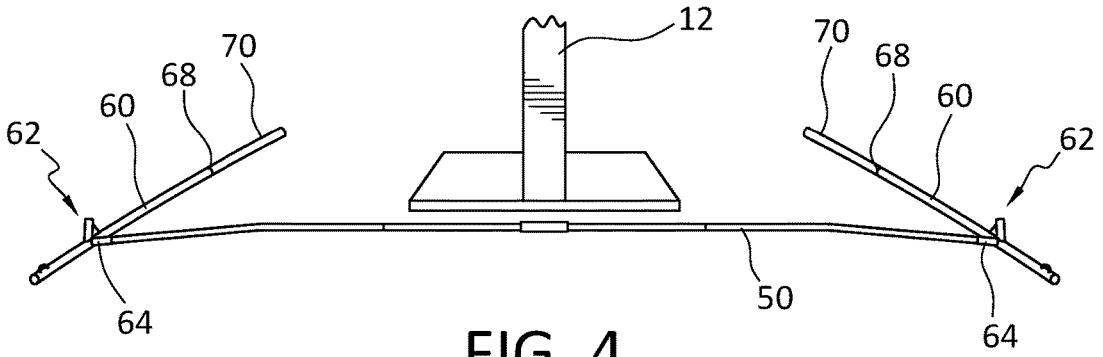
FIG. 4 is a front elevational view of a base of the backstop assembly of FIG. 1.

The steps for assembling the basketball backstop assembly 10 are illustrated in FIGS. 4-15. Referring first to FIG. 4, the base 50 and side legs 60 are joined together. In the embodiment shown, the base 50 comprises separable base bar or tube sections 52 with a cable 54 threaded through the sections 52. The cable 54 is generally stretchy or elastic and may be extended to a length that is longer than the combined lengths of the sections 52 when the sections are disposed in end to end relation. The side legs 60 may be rods or tubes onto which corner socket units 62 are joined or formed. The left side of the base 50 is removably insertable into a socket opening 64 of the left side leg 60, and the right side of the base 50 is removably insertable into a socket opening 64 of the right side leg 60.

The corner socket units 62 shown in FIG. 4 are disposed along the length of the left side leg and right side leg. Each socket opening 64 is directed at an angle away from the axis of the respective side leg. The corner socket units 62 additionally have socket openings 66 disposed at an angle from 90 to 120 degrees from the socket openings 64. The socket openings 66 are adapted to receive vertically extending rods or posts 90.

Figure 6:
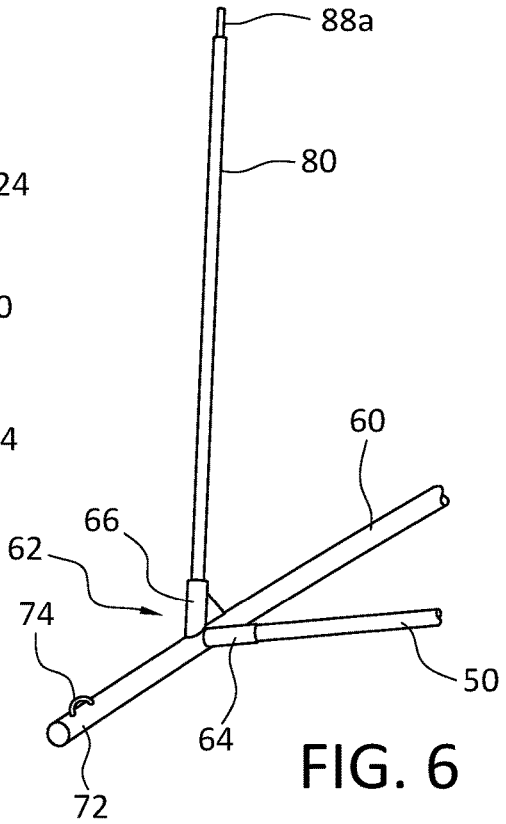
FIG. 6 is a front elevational view of the base and one of the vertical support rods or posts of the backstop assembly of FIG. 1.
Figure 7:
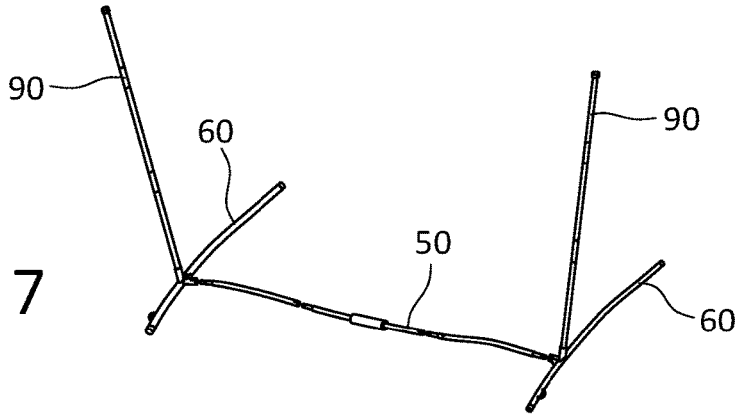
FIG. 7 is a front elevational view of the base and the vertical support rods of the backstop assembly of FIG. 1.

FIG. 6 shows the base 50 secured to the side legs 60, and one of the vertical rods 90 secured to one of the side legs 60. Together, the base 50, side legs 60 and vertical rods 90 comprise the support for the net 20. See also FIG. 7.

Optionally, rear leg extenders 70 are removably joined to the rear portions 68 of the side legs 60. When used, the rear leg extenders 70 slidably engage into the rear portions 68 of the side legs 60. Either the rear leg extenders 70, the side legs 60 or both may be staked to a ground surface with one or more stakes 76.

The front portions 72 of the side legs 60 may include a loop or hook 74 adapted to engage with a hook or loop 46 of a bungee cord 44.

Figure 5:
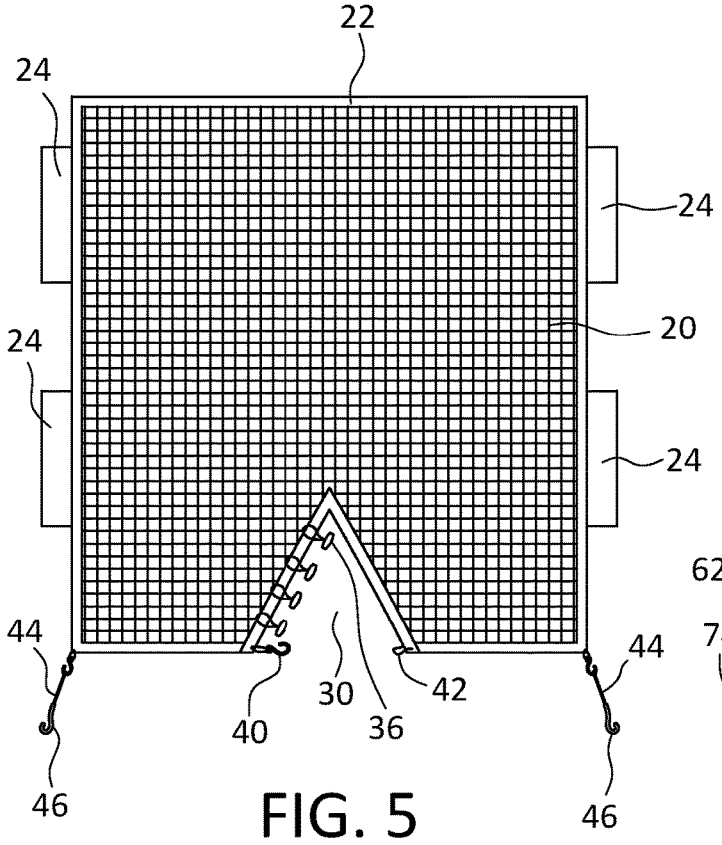
FIG. 5 is a front elevational view of a net of the backstop assembly of FIG. 1.

As shown in FIG. 5, the net 20 has a peripheral border 22 with side pockets 24 extending outwardly from the left and right side sections of the peripheral border 22. The side pockets 24 are shaped to receive the vertical posts or rods 90. Corner loops 26 are engaged to the top corners of the net peripheral border 22. Bungies or other stretchy cords 44 are engaged to the bottom corners of the net peripheral border 22. The bungies 44 terminate with hooks 46 adapted to engage with a respective loop or hook 74 of the front portions 72 of the side legs 60.

The bottom portion of the peripheral border 22 of the net 20 defines a slit opening 30. The slit opening 30 shown in FIG. 5 extends into the net 20 about ⅙ to ⅕ of the height of the net. One or more fasteners 36 such as toggles, are appended to the left side 32 of the slit opening 30. The right side 34 of the slit opening 30 may be joined to the left side 32 using the fasteners 32. In addition, the bottom portion of the net peripheral border 22 may have a hook 40 appended to the left side 32 of the slit opening 30 and a loop 42 extending from the right side 34 of the slit opening 30. The hook 40 may engage with the loop 42 to join the right side 34 of the slit opening 30 to the left side 32 of the slit opening 30. See FIGS. 14 and 15.

In the embodiment shown in the Figures, the vertical rods 90 comprise two sections. Referring to FIG. 6, a bottom section 80 of one of the vertical rods 90 is removably insertable into the socket opening 66 in a side leg 60. The proximal end of the bottom section has a threaded section 88*a* by which the bottom section 80 may be coupled to a top section 82 with a mating threaded section 88*b*. The distal end of the top section 82 terminates in a knob 84 or other protrusion to which one of the loops 26 at the top of the net peripheral border 22 may be joined. See FIGS. 7 and 11. Similarly, the other vertical rod 90 may be assembled and inserted into the socket opening 66 of the other side leg 60.

Figure 8:
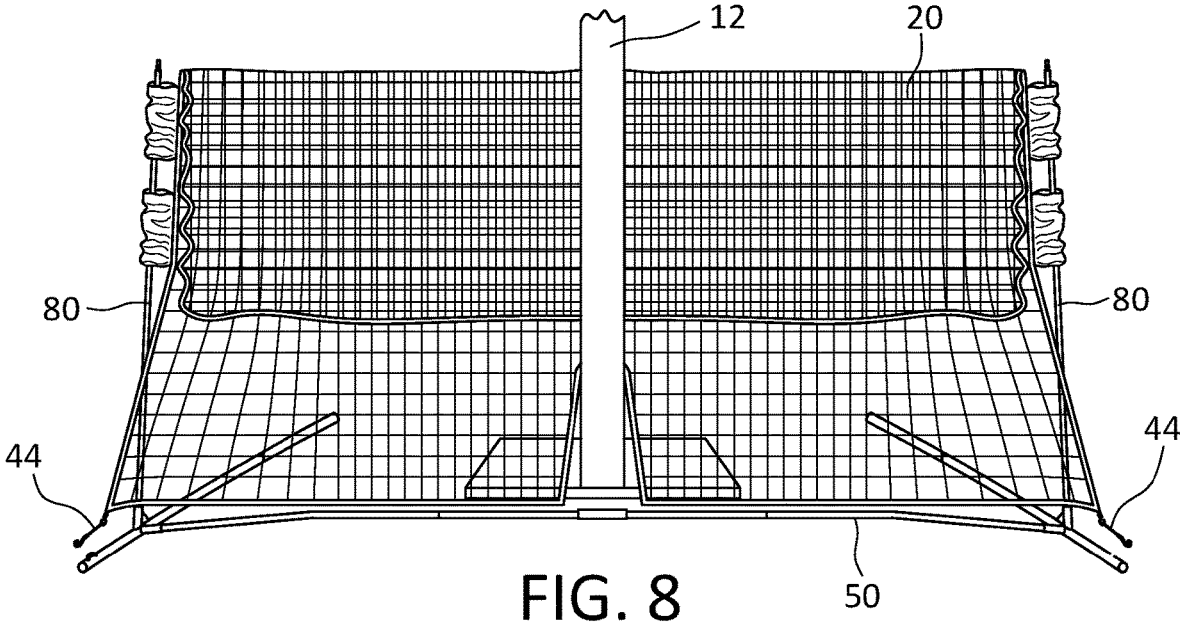
FIG. 8 is a front elevational view of a first step in attaching the net to the base and rods/posts of the backstop assembly.
Figure 9A:
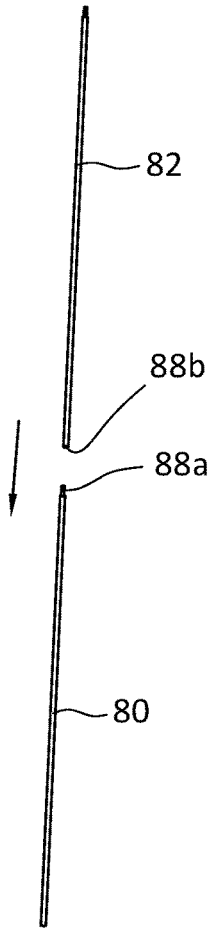
FIG. 9A is a front elevational view showing a step of joining two sections of a vertical rod together.
Figure 9:
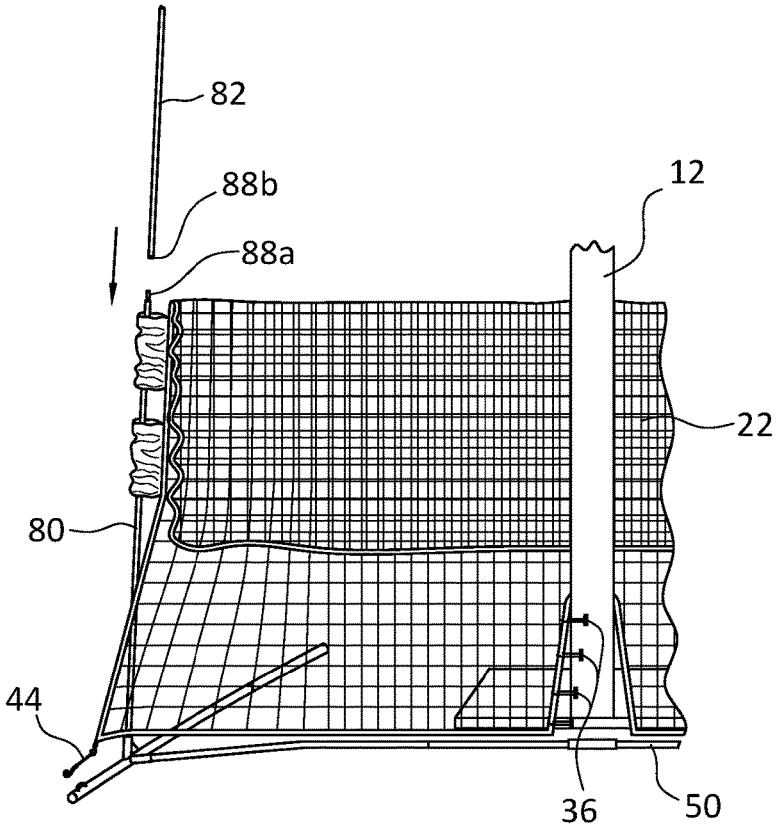
FIG. 9 is a front elevational view of a second step in attaching the net to the base and rods/posts of the backstop assembly.
Figure 10:
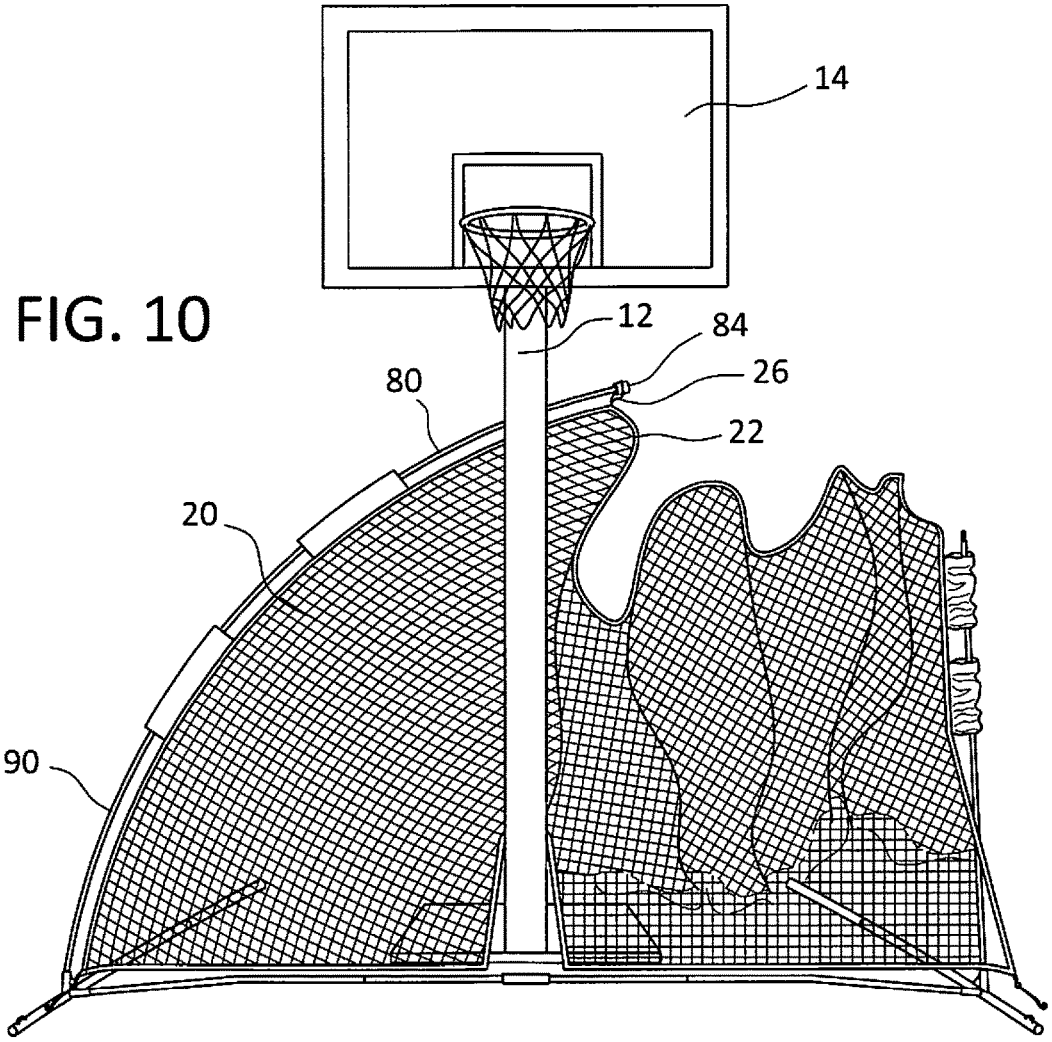
FIG. 10 is a front elevational view of a third step in attaching the net to the base and rods/posts of the backstop assembly.
Figure 11:
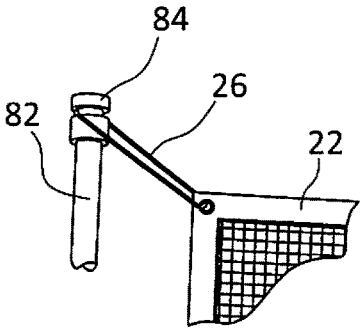
FIG. 11 is an enlarged view showing attachment of a loop extending from a top corner of the net to a top of a vertical rod.
Figure 13:
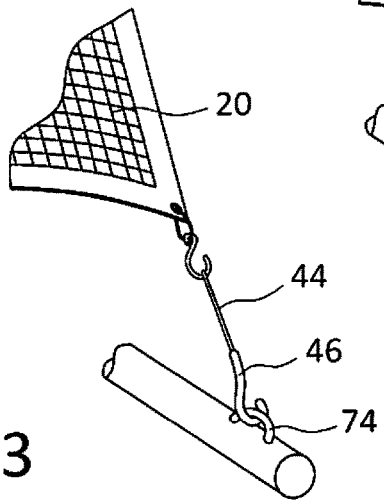
FIG. 13 is an enlarged view showing attachment of a hook on a bungee extending from a bottom corner of the net assembly to a front of a side leg.
Figure 12:
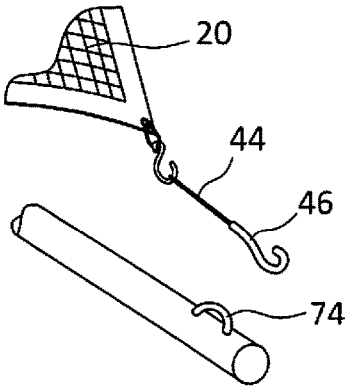
FIG. 12 is a front elevational view of a fourth step in attaching the net to the base and rods/posts of the backstop assembly.
Figure 14:
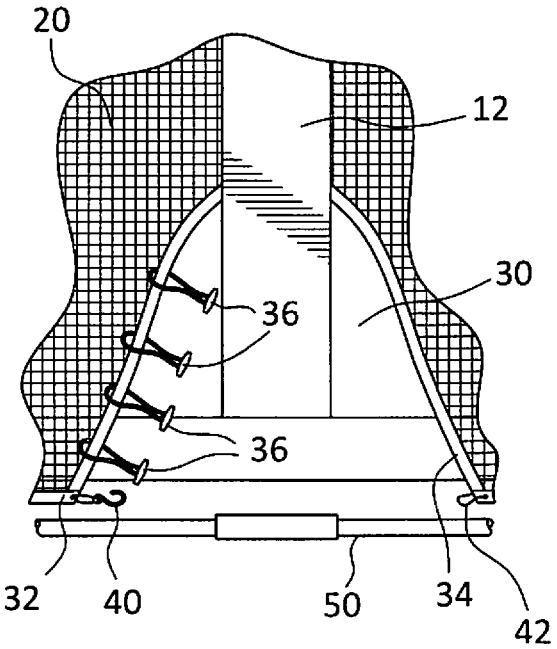
FIG. 14 is an enlarged view of a slit opening in a bottom portion of the net, showing engagement of the slit opening around the post of the basketball backboard.
Figure 15:
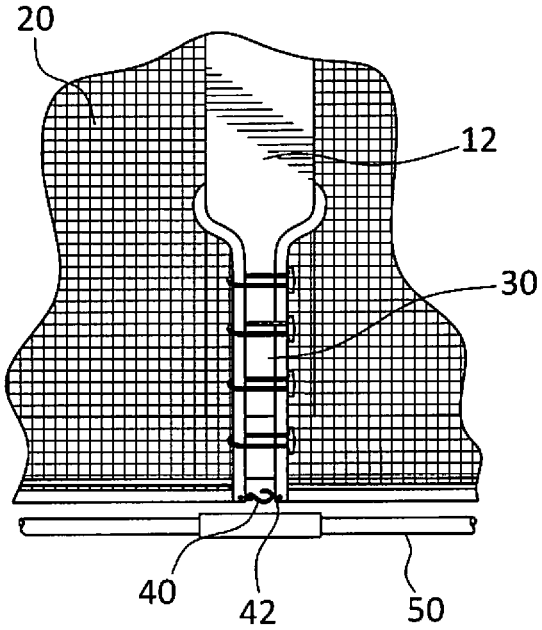
FIG. 15 is an alternative enlarged view of the slit opening in a bottom portion of the net showing engagement of the slit opening around the post of the basketball backboard.

Referring next to FIGS. 8-10, the basketball backstop assembly 10 is assembled adjacent to a post 12 of a basketball backboard 14. The base 50 is placed in front of the post 12. The net 20 is placed behind the post 12. The slit opening 30 in the net 20 is opened so that the post 12 extends through the slit opening 30. See FIG. 14.

The net 20 is joined to the vertical rods 90 and side legs 60 according to the following steps. First, the vertical rods 90 are threaded through respective pockets of sleeves 24 at each side of the net 20. See FIGS. 8 and 9. The loops 26 at the top corners of the net 20 are joined to the respective knobs 84 at the tops of the vertical rods 90 to the left and right of the assembly 10. See FIGS. 7 and 11. The vertical rods 90 preferably are formed of fiberglass. The rods 90 are flexible and, based on the angle of the sockets 66 and rod material flexibility, the rods 90 bend away from one another stretching the top portion of the net 20. The top of the net peripheral border 22 thus is held in tension behind the backboard 14 as shown in FIGS. 1, 2 and 16.

The hooks 46 on the bungie cords 44 extending from the bottom corners of the net 20 are joined to the respective loops or hooks 74 at the front portions of the side legs 60. See FIGS. 9, 12 and 13.

Finally, the hook 40 may be joined to the loop 42 on the net peripheral border 22 at or adjacent to the slit opening 30. In addition, the right side 34 of the slit opening 30 may be joined to the fasteners 36 on the left side 32 of the slit opening 30. In this manner, the slit opening is closed around the post 12. See FIGS. 14 and 15.

The freestanding assembled basketball backstop assembly 10 rebounds basketballs to a player. Basketballs tossed toward the basketball backboard 12 and hoop 16 that drop onto the net 20 are bounced off the net and rebounded toward the player.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

REFERENCE NUMBERS

10 basketball backstop assembly
12 vertical post for backboard
14 backboard
16 hoop
18 basketball net
20 net of the backstop assembly
22 net peripheral border
24 side sleeves/pockets
26 corner loops at top of net
30 slit opening
32 left side of slit
34 right side of slit
36 fasteners/toggles
40 hook on slit
42 loop on slit
44 bungee cord at net corner

46 hook on bungee cord
50 base
52 base bar sections
54 cable inside base bar sections
60 side legs
62 socket unit
64 socket opening to receive base sections
66 socket opening to receive vertical bars
68 rear portions of side legs
70 rear leg extenders
72 front of side legs
74 loop or hook
76 stake
80 bottom section of vertical rod
82 top section of vertical rod
84 knob on top of top section
88 coupling for top and bottom rod sections
90 vertical rods

The invention claimed is:

1. A basketball backstop assembly, comprising:

a base having a first end and a second end and a base length between the first end and the second end, said base configured for positioning in front of a post supporting a basketball backboard, wherein said basketball backboard has a bottom edge spaced apart a height from a basketball playing surface;

a right side leg having a right side length and defining a first axis along the right side length, said right side leg having a first receiving socket along the right side length that is disposed at a first angle to the first axis, and having a second receiving socket along the right side length that is disposed at a second angle to the first axis, said first end of the base removably attachable to the first receiving socket;

a left side leg having a left side length and defining a second axis along the left side length, said left side leg having a third receiving socket along the left side length that is disposed at a first angle to the second axis, and having a fourth receiving socket along the left side length that is disposed at a second angle to the second axis, said second end of the base removably attachable to the third receiving socket;

a right vertical rod removably attachable to the second receiving socket, said right vertical rod having a right rod length that is longer than the height of the bottom edge of the basketball backboard from a basketball playing surface;

a left vertical rod removably attachable to the fourth receiving socket, said left vertical rod having a left rod length that is longer than the height of the bottom edge of the basketball backboard from a basketball playing surface;

a net defining a peripheral border having a top, a bottom, a right side and left side, said net having at least one right sleeve associated with the right side and at least one left sleeve associated with the left side, and said net defining at least one slit through the bottom peripheral border, wherein said slit defines a slit opening configured to receive the post supporting the basketball backboard;

at least one cord depending from a first bottom corner of the net peripheral border between the right side and the bottom, said at least one cord adapted for removably joining to the right side leg in a cord-connecting position forward of the post supporting the basketball backboard;

at least a second cord depending from a second corner of the net peripheral border between the left side and the bottom, said at least second cord adapted for removably joining to the left side leg in a cord-connecting position forward of the post supporting the basketball backboard;

at least one loop depending from a first top corner of the net peripheral border between the right side and the top, said at least one loop adapted for removably joining to a top portion of the right vertical rod; and at least one loop depending from a second top corner of the net peripheral border between the left side and the top, said at least one loop adapted for removably joining to a top portion of the left vertical rod; and wherein the top peripheral border of the net is held in tension between the right vertical rod and the left vertical rod and is positioned behind the basketball backboard.

2. The basketball backstop assembly of claim 1, further comprising a second right vertical rod removably attachable to the right vertical rod, and a second left vertical rod removably attachable to the left vertical rod.

3. The basketball backstop assembly of claim 2, wherein the at least one loop depending from the first top corner of the net peripheral border is adapted for removably joining to a top portion of the second right vertical rod instead of the right vertical rod, and the at least one loop depending from the second top corner of the net peripheral border is adapted for removably joining to a top portion of the second left vertical rod instead of the left vertical rod.

4. The basketball backstop assembly of claim 1, wherein the right vertical rod and the left vertical rod are formed of fiberglass.

5. The basketball backstop assembly of claim 1, further comprising a right leg extender removably attachable to the right side leg.

6. The basketball backstop assembly of claim 1, further comprising a left leg extender removably attachable to the left side leg.

7. The basketball backstop assembly of claim 1, wherein the base comprises multiple base sections removably joined together.

8. The basketball backstop assembly of claim 7, wherein the base sections comprise hollow tubes or rods, and a third cord or a rope is threaded through the hollow tubes or rods.

9. The basketball backstop assembly of claim 1, further comprising at least one fastener associated with the slit in the bottom peripheral border of the net.

10. The basketball backstop assembly of claim 1, wherein the net has a net face defining a net length and a net width, and wherein the slit extends from the bottom of the peripheral border to a length that is less than the net length.

11. The basketball backstop assembly of claim 10, further comprising a plurality of fasteners to join a first slit edge to a second slit edge of the slit.

12. The basketball backstop assembly of claim 1, further comprising a first stake adapted for securing the right side leg to a ground surface, and a second stake adapted for securing the left side leg to a ground surface.

13. The basketball backstop assembly of claim 1, wherein the second socket is at an angle to the first socket of from 90 to 120 degrees.

14. The basketball backstop assembly of claim 1, wherein the third socket is at an angle to the fourth socket of from 90 to 120 degrees.

15. The basketball backstop assembly of claim 1, wherein the at least one left sleeve comprises a plurality of left sleeves, and the at least one right sleeve comprises a plurality of right sleeves.

16. The basketball backstop assembly of claim 1, wherein upon assembling the assembly, the assembly is freestanding without support connections to a basketball backboard or a post supporting the basketball backboard.

17. The basketball backstop assembly of claim 9, wherein the at least one fastener secures bottom edges of the slit together so that the slit surrounds the post supporting the basketball backboard.

18. The basketball backstop assembly of claim 1, wherein the right vertical rod is flexible and the left vertical rod is flexible.

* * * * *